US007164125B2

(12) United States Patent
Weiss et al.

(10) Patent No.: US 7,164,125 B2
(45) Date of Patent: Jan. 16, 2007

(54) RF QUADRUPOLE SYSTEMS WITH POTENTIAL GRADIENTS

(75) Inventors: Gerhard Weiss, Weyhe (DE); Jochen Franzen, Bremen (DE); Carsten Stoermer, Bremen (DE)

(73) Assignee: Bruker Deltonik GmbH (DE)

( * ) Notice: Subject to any disclaimer, the term of this patent is extended or adjusted under 35 U.S.C. 154(b) by 66 days.

(21) Appl. No.: 11/090,316

(22) Filed: Mar. 25, 2005

(65) Prior Publication Data

US 2005/0274887 A1 Dec. 15, 2005

(30) Foreign Application Priority Data

Mar. 25, 2004 (DE) ..... 10 2004 014 584

(51) Int. Cl.
*H01J 49/42* (2006.01)

(52) U.S. Cl. ..... 250/292

(58) Field of Classification Search ..... None
See application file for complete search history.

(56) References Cited

U.S. PATENT DOCUMENTS

| | | | | |
|---|---|---|---|---|
| 3,233,098 A | | 2/1966 | Reich | |
| 3,334,225 A | * | 8/1967 | Langmuir | 250/292 |
| 3,699,330 A | | 10/1972 | McGinnis | |
| 4,213,557 A | | 7/1980 | Franzen et al. | |
| 4,963,736 A | | 10/1990 | Douglas et al. | |
| 5,572,035 A | | 11/1996 | Franzen | |
| 5,847,386 A | | 12/1998 | Thomson et al. | |
| 5,852,302 A | | 12/1998 | Hiraishi et al. | |
| 7,064,322 B1 | * | 6/2006 | Crawford et al. | 250/290 |
| 2006/0169890 A1 | * | 8/2006 | Crawford et al. | 250/290 |

FOREIGN PATENT DOCUMENTS

| | | |
|---|---|---|
| EP | 0 817 239 B1 | 6/2003 |
| WO | WO 97/07530 A1 | 2/1997 |

OTHER PUBLICATIONS

Performance of the Quadrupole Mass Filter With Separated RF and DC Fringing Fields; P.H. Dawson; Division of Physics, National Research Council, Ottawa, KIA OR6 (Canada); Apr. 18, 1977, pp. 375-393.

Über nichtlineare Resonanzen im elektrischen Massenfilter als Folge von Feldfehlern, F. v. Busch and W, Paul Zeitschrift für Physik 164,588-594 (1961).

* cited by examiner

*Primary Examiner*—Jack I. Berman
(74) *Attorney, Agent, or Firm*—Law Offices of Paul E. Kudirka

(57) ABSTRACT

The invention relates to two-dimensional quadrupole systems along whose axis an axial DC field is superimposed. The invention involves coating the hyperbolic or cylindrical surfaces of quadrupole systems with thin insulating layers and metal films thereupon and generating axial potential gradients or saddle ramps using appropriate electrical supply of DC potentials and superimposed RF voltages to the metal films. Systems of this type can be used in a plurality of ways, ranging from mass filters with high transmission to fragmentation cells with extremely low ion losses.

11 Claims, 2 Drawing Sheets

RF QUADRUPOLE SYSTEMS WITH POTENTIAL GRADIENTS

FIELD OF THE INVENTION

The invention relates to two-dimensional quadrupole systems along whose axis an axial DC field is superimposed.

BACKGROUND OF THE INVENTION

There has been a long search for radially-repelling ion confinement systems with axially superimposed DC electric fields for various types of applications: for ion guides, for the generation of monoenergetic ion beams, and in particular for collision cells used to fragment and thermalize ions. In such systems it is possible, for example, to not only fragment ions by means of collisions but also to thermalize them, the ions being transported to the ion exit at the end of the system either subsequently or simultaneously by a weak axial DC field. Even for high-resolution mass filters with two-dimensional quadrupole RF fields, a DC potential profile along the axis would offer completely new possibilities, particularly with respect to high transmission and operation at a high damping gas pressure. The term "two-dimensional quadrupole fields" is used to describe the fields which appear in systems comprising four round or hyperbolic lengthy electrodes, as is the usual practice in specialist literature.

Since there are numerous applications for the quadrupole RF electrode systems with their radial retaining force, and hence numerous ways of denoting them, for example mass filters, ion guides, fragmentation cells or thermalization cells, the term "quadrupole systems" is used below where a more precise specialization is not required. What is meant by these quadrupole systems, figuratively speaking, is the confinement of ions in a virtual tube with radially increasing repelling forces. Quadrupole systems with axial potential gradients correspond to sloping tubes in which the content flows in one direction under the influence of the slope.

The simplest (and longest known) solution for the superimposition of a longitudinal electric field consists in making a quadrupole electrode system out of four thin resistance wires, along each of which a DC voltage drop is generated. But the thin wires require a quite high RF voltage in order to generate the quadrupole RF field, since the largest voltage drop occurs in the immediate vicinity of the thin wire. Furthermore, the resistance must not be too high, otherwise the RF voltage fed at the ends cannot propagate along the wires sufficiently quickly. It is therefore only possible to generate rather small DC voltage drops along the wire. Also, it is difficult to generate a desired profile of the DC electric field along the axis. Moreover, the pseudopotential barrier between the wires is very low; the ions can escape very easily.

Pseudo-hyberbolic quadrupole systems comprising a large number of clamped wires which imitate the four hyperbolic surfaces of an ideal quadrupole system represent a further possibility. Hyperbolic quadrupole systems replicated in wire like this were already being used around 40 years ago by Wolfgang Paul and his coworkers (Nobel-price winner Wolfgang Paul is the inventor of all quadrupole systems). These quadrupole systems made from wires are difficult to produce, however, and not very precise, but they do provide a simple way of generating an axial DC field by generating voltage drops along the wires.

Other ion storage systems which have an electrically generated forward drive are known from U.S. Pat. No. 5,572,035 (J. Franzen). This patent concerns different types of ion guides, for example a system comprising only two helical, coiled conductors in the shape of a double helix, operated by being connected to the two phases of an RF voltage. Another guide system consists of coaxial rings to which the phases of an RF AC voltage are alternately connected. Both systems can be operated in such a manner that an axial feed of the ions is generated. It is thus possible to make the double helix out of resistance wire across which a DC voltage drop is generated. The individual rings of the ring system can be supplied with a DC potential which decreases in steps ring by ring, as described in the patent.

U.S. Pat. No. 5,847,386 (B. A. Thomson and C. L. Jolliffe) describes seven different ways to generate an axial voltage drop in quadrupole round-rod systems. Since five of these types distort the inner quadrupole potential, we here consider only the two types which leave the RF quadrupole potential undisturbed: (a) a quadrupole rod system made of nonconducting round rods to which resistance layers have been applied, a voltage drop being generated along each of these; and (b) a quadrupole rod system whose rods are made of nonconducting thin-walled ceramic tubes, coated on the outside with a high-resistance layer for a DC voltage drop and on the inside with a metal layer for the RF supply; the RF voltage being intended to act through both the insulator and, with slight attenuation, through the high-resistance layer as well, in order to form the quadrupole RF field.

These devices are, however, not particularly satisfactory: System (a), comprising nonconducting rods with resistive coating, conducts the RF voltage only in a limited way (similar to the system made of four resistance wires), so that the RF voltage varies along the system, an occurrence which is extraordinarily damaging for some applications; or the resistive coating must have an extremely low resistance.

System (b), made of thin ceramic tubes (according to the specification, tube walls some 0.5 to 1 millimeter thick) with inner metal coating to generate the RF fields and outer high-resistance layer for the DC voltage drop, is also very disadvantageous. The aim of the inventor as given in the specification is that the RF voltage acts through the dielectric ceramic and through the high-resistance layer which, according to the description, should have a resistance of 1 to 10 Megohms per square surface. The specification indicates a penetration of the high-resistance layer by means of the known effect of a "leaky dielectricum" as the following citation describes: "The surface resistivity of the exterior resistive surface 176 will normally be between 1.0 and 10 Mohm per square. A DC voltage difference indicated by V1 and V2 is connected to the resistive surface 176 by the two metal bands 174, while the RF from power supply 48 (FIG. 1) is connected with the interior conductive metal surface. The high resistivity of the outer surface 176 restricts the electrons in the outer surface from responding to the RF (which is at a frequency of about 1.0 MHz), and therefore the RF is able to pass through the resistive surface with little attenuation. At the same time voltage source V1 establishes a DC gradient along the length of the rod . . . ". (underlining added). A cylinder made of high-resistance material penetrated by RF as a "leaky dielectricum" in precisely this sense has long been known (P. H. Dawson, "Performance of the Quadrupole Mass Filter with Separated RF and DC Fringing Fields", Int. J. Mass Spectrom. Ion Phys., 25 (1977) 375–392). According to this idea of the penetration of the high-resistance layer (see FIG. 28A of this patent specification and the text cited above) this layer is connected only to the DC voltage source without any contact of its own to the RF source. This invention is not successful in practice: It is not only the fact that the authors underestimate the strength of the RF attenuation when penetrating the high-resistance layer, but also that high dielectric losses occur in the material of the ceramic tubes as a result of the RF, so that the system in the vacuum becomes hot within a short time and can even begin to glow. In addition, the round rods made of the thin ceramic tubes are mechanically not particularly stable. This technology seems to us to be quite unusable; as far as we know it has never been used in practice.

It is remarkable that for quadrupole systems, and particularly for collision cells as well, RF rod systems with round rods are used as a rule, even though hyperbolic systems were introduced 30 years ago for high-quality quadrupole mass spectrometers, said systems providing significantly better separation efficiencies and transmissions. Inexpensive round-rod systems were always considered good enough for the collision chambers, expensive hyperbolic systems were not used at all.

However, from the work of F. von Busch and W. Paul, Z. Phys. 164, 588 (1961) it is already known that in round-rod quadrupole filters there are non-linear resonances which lead to the ejection of certain ions with motion parameters within the Mathieu stability zone which should therefore be stably collected. In three-dimensional RF ion traps, these resonances lead to the phenomenon of the so-called "black holes", which occur for the same reason in rod systems, particularly in round-rod systems. Round-rod systems contain octopole and higher even-numbered multipole fields of considerable strength superimposed on the quadrupole field, leading to a distortion of the ion oscillations in the radial direction and hence to the formation of higher harmonics of the ion oscillation. Their matching with the Mathieu side bands leads to these resonances. The resonances occur, however, only when the ions undergo relatively wide radial oscillations. For ions lying damped in the axis of the system, the resonances are not effective since there, the higher multipole fields and hence the overtones (higher harmonics) disappear.

In quadrupole systems used as collision cells, the ions are injected with high energy of between 30 and 100 electron-volts. Necessarily large numbers of ions are brought, by means of collision cascades, far outside the central axis. These ions are therefore inevitably subjected to the phenomenon of non-linear resonances if they fulfil one of the numerous resonance conditions. Specific species of daughter ions can thus disappear from the collision cell and hence from the daughter ion spectrum. In the most unfavorable case, even the parent ions selected are subject to this resonance and most of them disappear from the collision cell.

Moreover, round-rod systems have the further disadvantage that the pseudopotential barrier between the rods is quite low (in commercially available systems only some ten to twenty volts) and can easily be overcome by ions with an energy of 50 electron-volts, the minimum usually required for fragmentation processes, by means of a random, laterally deviating collision cascade. This escape affects both parent and daughter ions. The higher the mass of the collision gas molecules, the more ions are lost, because in this case, the angles of deflection per collision are greater. A cascade of a small number of collisions which coincidentally deflect in the same lateral direction is enough to remove the ion from the collision cell. The larger angles of deflection of a small number of collisions are not able to compensate each other statistically as effectively as the large number of smaller angles of deflection in the case of a very light collision gas.

For other quadrupole systems, and even for precision mass filters to some extent, round-rod systems with suitable dimensions have proved to be successful.

In tandem mass spectrometers, the parent ions are generally selected from a primary ion mixture by a quadrupole mass filter; then fragmented in a collision cell. After fragmentation, the daughter ions can be analyzed either by quadrupole mass spectrometers, by time-of-flight mass spectrometers with orthogonal ion injection, by RF ion traps or by ion cyclotron resonance spectrometers. The daughter ion spectrum (or "fragment ion spectrum") delivers information about the structure of the parent ions. Consequently, at least two types of "quadrupole systems" are used in tandem mass spectrometers: a quadrupole mass filter to select the parent ions, and a quadrupole collision cell to fragment the ion species selected. Usually, there is even an additional thermalization quadrupole for the ions injected into the mass filter (U.S. Pat. No. 4,963,736, D. J. Douglas and J. B. French), and in so-called "Triple Quads" there is a second quadrupole mass filter to analyze the daughter ions, so that this type of system can comprise a total of four quadrupole systems. For some of these quadrupole systems, for example for the thermalization systems, it is highly advantageous to have a forward drive of the ions and, as a rule, this forward drive of the ions must also be switchable and adjustable.

For many quadrupole system applications it is consequently very interesting to generate a potential profile along the axis and to be able to change it while in operation, and also to be able to generate various profiles of the potential characteristic.

SUMMARY OF THE INVENTION

The invention provides a quadrupole system with axial potential profiles. It uses four mechanically stable lengthy electrodes for the quadrupole system, applies a thin layer of conductive material to the surfaces of each electrode, said layer of conductive material being separated from the bulk electrode below by a very thin insulating layer. Each electrode and both ends of their conductive layers are connected to distinct DC potentials, superimposed each by one of the two phases of the RF voltage, so that the conductive layers carry both the RF voltage and also can generate DC potential gradients. The potential gradients can be changed by time by changing the DC potentials at the connections. Favorably the conductive layers have resistances between one and a hundred kilohms. The phase of the superimposed RF voltage changes in turn from electrode to electrode. The conductive layers may be made from metal.

In contrast to the description in U.S. Pat. No. 5,847,386, which teaches away from the invention introduced here, the thin conductive layers in this case are connected directly to the RF voltage through the connections on their ends and not only indirectly through the capacitive coupling to the electrode beneath through the thin insulating layer. The RF voltage does not have to penetrate the thin conductive layers as "leaky dielectricum," in this case, (which would also require the thin metal layer to have an extremely high specific resistance excluding normal metal layers) because the thin layer of conductive material itself is directly connected to the RF voltage, on the one hand, and capacitively supported from the RF voltage supplied to the bulk electrode beneath on the other. In the following, the conductive layers are always denominated as "thin metal layers".

In special embodiments, the thin metal layers can each be electrically connected at one ore more points with the lengthy electrodes beneath. It is then possible to generate axial electric field profiles consisting of at least two potential gradients, and also more complex axial DC field configurations, as will be described below.

If a voltage drop in the same direction and with the same magnitude is generated across all four thin metal layers, one obtains an axial electric field which drives the ions in the interior in one direction. If voltage drops running in the opposite direction are generated across the thin metal layers, it is possible to generate other field configurations, for example a continuous entrance ramp into a quadrupole mass filter to increase the ion acceptance, something which has not been possible to produce until now.

The quadrupole system can particularly consist of hyperbolic lengthy electrodes, the hyperbolic surfaces being arranged diagonally opposite each other. Compared with the round-rod systems frequently used today, a hyperbolic quadrupole system of this type has the advantage that, firstly, the ions do not escape as a result of nonlinear resonances and, secondly, (in the mode where DC voltages are not superimposed with opposite polarity on the two RF phases, a so-called "RF-only" mode) the repelling pseudopotentials have the same parabolic rise from the axis in all radial directions, i.e., they supply the same repelling forces from all radial directions. Escape of ions via too low a pseudopotential barrier between the pole rods through laterally deflecting collision cascades is almost completely prevented. A hyperbolic system of this type is particularly advantageous as a collision cell for ion fragmentations.

The desired DC voltage supply of the thin metal layer can, for example, be generated via a transformer having two or three identical secondary windings with center taps. The DC potentials for the ends of the thin metal layers and for the supporting electrodes are fed in at the "cold" center taps of the secondary windings, whereby the desired DC potentials with superimposed phases of the RF voltages are delivered from both ends of each of the two or three secondary windings. The DC potentials here can be adjustable. If three secondary windings are used, and if the thin metal layers are connected to the lengthy electrodes through the insulating layer at one point each, simple field profiles with two potential DC field gradients in axial direction may be produced. With two through-hole connections per lengthy electrode, it is possible to generate a somewhat more complicated potential profile, with no voltage drop and hence no axial field between the two through-hole connections in the quadrupole system. More complicated profiles can be generated with additional taps, which can be supplied with voltages from the outside, and with more than three secondary windings.

A quadrupole system with axial DC field profiles or other field configurations can be used for a number of different types of application ranging from mass filters with forward drive, mass filters with high transmission, mass filters for operating at high damping gas pressure, ion guides with ion drive, collision cells for ion fragmentation, and thermalization cells for generating monoenergetic ion beams.

DETAILED DESCRIPTION

Figure 1:
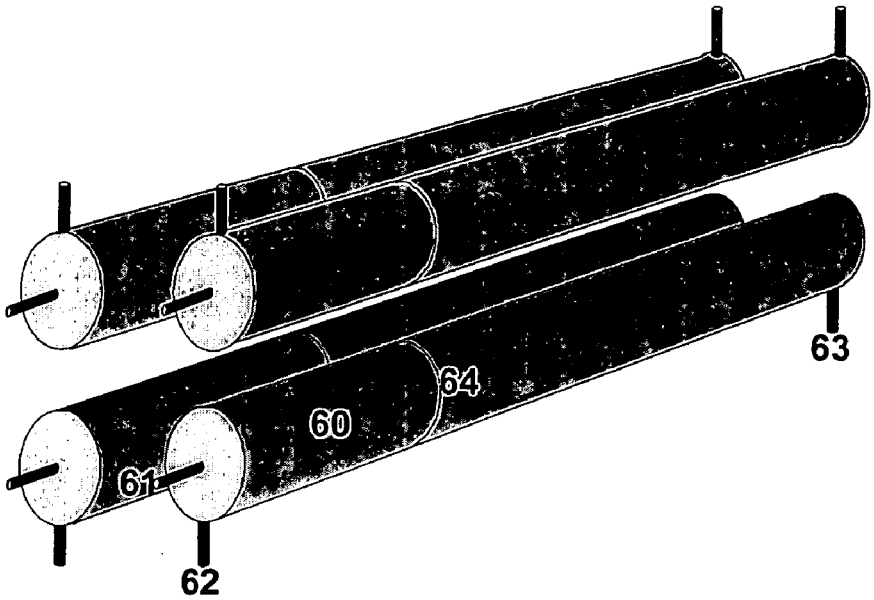
FIG. 1 shows a quadrupole system made of round rods (60) with schematically drawn connections (61) for the round-rod electrodes and connections (62, 63) for the ends of the insulated thin metal layers; the thin metal layers here are connected to the round-rod electrodes beneath at the location (64) in such a way that two different potential gradients in parts (62–64) and (64–63) can be produced along the rod system.

A first embodiment as shown in FIG. 1 consists of a round-rod quadrupole system whose rods (60) are coated with a thin layer of metal over a thin insulating layer. The thin layers of metal are connected via the schematically represented connectors (62, 63) with DC potentials on which, according to the invention, the same phase of the RF voltage is superimposed. The lengthy bulk electrodes themselves are connected via the connectors (61) to a DC potential superimposed with the two phases of the RF voltage. Opposing pairs of the electrodes and their thin metal layers each carry DC voltages superimposed by the same phase of the RF voltage. At the location (64), the thin metal layers are connected to the round-rod electrodes beneath; the DC potential of the round rods therefore lies across the thin metal layers. It is therefore possible to produce different field gradients on either side of these through-hole connections (64).

Figure 2:
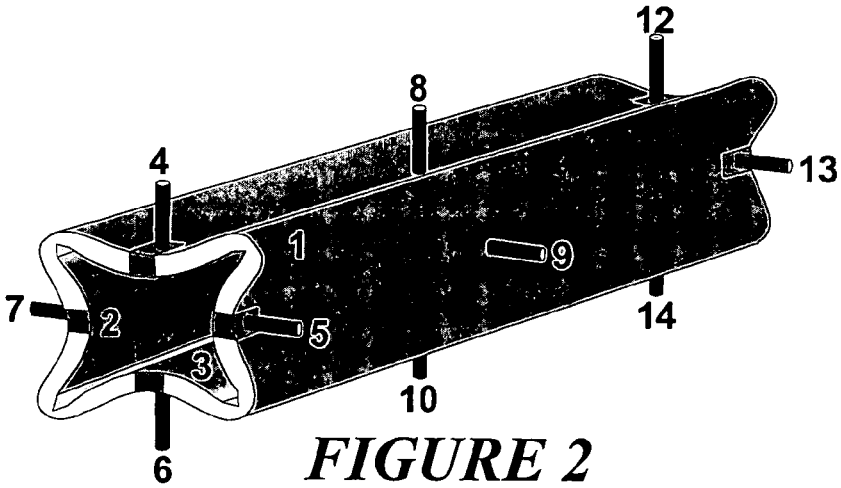
FIG. 2 shows a glass quadrupole system. The hyperbolic electrode sheets (2, 3) are fused onto the inside of the glass body (1), and the resistance layers are vapor deposited onto these electrode sheets over a thin insulating layer. The connector pins (4, 5, 6, 7, and 12, 13, 14) bring DC potentials, onto which RF is superimposed, to the ends of the thin metal layers; the connector pins (8, 9,10) guide the RF voltage to the electrode sheets.

A second embodiment as shown in FIG. 2 presents a precision quadrupole mass filter comprising a glass body (1) with four hyperbolic electrode sheets (2, 3) fused on using a hot molding process. A quadrupole mass filter of this type can be produced in accordance with patent specification DE 2737903 (U.S. Pat. No. 4,213,557). It is extraordinarily precise at maintaining all dimensions. The hyperbolic electrode sheets (2, 3) are coated with a layer of a varnish with good insulating properties, for example a polyimide varnish, only a few micrometers thick. When dry, a very thin layer of metal, e.g., chromium or tungsten, only a few nanometers thick can be vapor deposited onto the insulating layer in a vacuum. It is thus possible to produce reproducibly a layer with a resistance of five kilohms, in other cases also with 50 kilohms. The ends of these layers are bonded by means of an electrically conductive varnish to connectors, as shown in FIG. 1.

The vapor-deposited thin layer of metal extends to the end surfaces and also over the glass, so that connector pins (4, 5, 6, 7, 12, 13, 14) can be connected here with the thin metal layer on the electrodes (2, 3) via a conductive varnish. For a voltage drop of five volts and a resistance of 5 kilohms, a current of one milliampere flows with a five milliwatt loss of power. A voltage drop of five volts is sufficient for most applications; a smaller voltage drop is usually needed.

Instead of the thin layer of chromium or tungsten it is also possible to coat with a resistance layer made of another metal or another conductor. The longitudinal resistance of this type of resistance layer should not exceed a hundred kiloohms.

Figure 4:
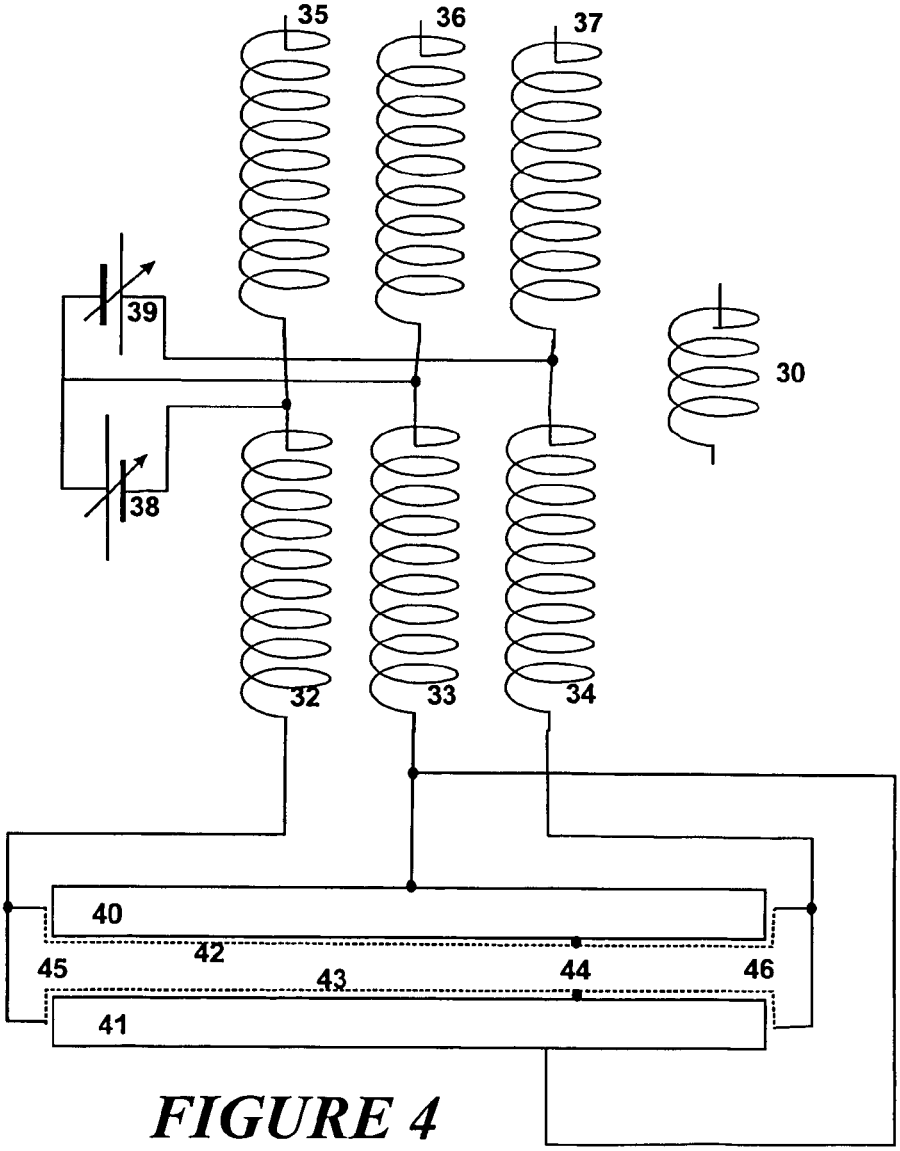
FIG. 4 shows the schematic representation of a possible voltage supply. The primary coil (30) induces identical RF voltages in three secondary windings. The hot end (33) of the secondary winding (33–36) is connected to the hyperbolic electrodes (40) and (41), and the hot end (36) is connected to the two other (not visible) hyperbolic electrodes. The center points of the two other secondary windings (32–35) and (34–37) are fed by two adjustable DC power supplies (38) and (39) respectively. The hot ends (32) and (34) generate a DC voltage drop on the thin metal layers (42) and (43) while being connected to the same phase of the RF voltage. At position (44) the metallic resistance layers are connected to the hyperbolic electrodes underneath so that it is possible to set two independent voltage drops in the sections (45, 44) and (44, 46); these voltage drops generate an axial field profile.

The resistance layer can also be connected to the lengthy bulk electrode beneath at a defined location by means of a gap in the insulating layer, as shown in FIGS. 1 and 4. The gap can extend over the total cross section of the resistance layer, or only over parts of the cross section. If the gap in the insulating layer does not extend over the total cross section of the lengthy electrodes, the shape of the potential gradients which is generated has a rounded appearance rather than a sharp bend. With the help of these through-hole connections it is possible to produce sections of the quadrupole system whose potential gradients have different magnitudes and even different directions.

Figure 3:
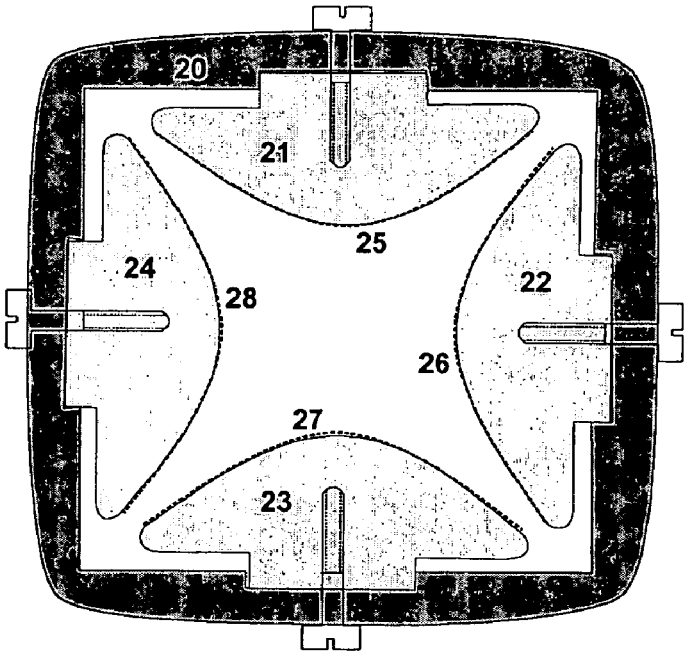
FIG. 3 illustrates a quadrupole system made of rigid aluminum electrodes (21, 22, 23, 24) onto whose anodized oxide layer the metallic resistance layers (25, 26, 27, 28) are applied. The quadrupole system is screwed into a glass holder (20) with precise internal cross section.

A third embodiment is shown in FIG. 3. Here, individual hyperbolic electrodes (21, 22, 23, 24) are made of aluminum and then strongly anodized to generate an oxide layer. The thin metal layers (25, 26, 27, 28) are then vapor deposited onto the oxide layer of the hyperbolic surface. The electrodes are equipped with threads and screwed into an insulating holder (20), which can be a precisely formed glass body produced in a hot-replica technique.

As those skilled in the art will recognize, the lengthy electrodes of the quadrupole systems can also be made of other electrode materials, which then can be coated with an insulating oxide layer and, of course, it is also possible to use an insulating varnish or any other type of insulating coating here. It is also possible to use other types of insulating frames such as ground ceramic rings to hold the electrodes. Those skilled in the art will also be aware that, for precision quadrupole systems, special measures such as repeated stress-relief annealing must be carried out.

Moreover, it will also be recognized that even more types of precision quadrupole systems whose electrodes have cylindrical or hyperbolic surfaces are possible, as are additional manufacturing methods. The surfaces of quadrupole electrodes produced in this way can then easily be coated with the insulating and resistance layers according to the invention.

As a general rule, the thin insulating layer should not be thicker than around 10 micrometers in order to achieve good capacitive coupling of the thin layer of metal to the lengthy electrode. The insulating strength of the thin insulating layer can nevertheless be very high. It is therefore possible, for certain applications, to also apply DC voltage differences of a few hundred volts between the thin layer of metal and the bulk electrodes, even though the layer is very thin.

A favorable embodiment for a voltage supply is illustrated schematically in FIG. 4. The voltage is supplied by a transformer which uses a primary winding (30) and three secondary windings (32–35), (33–36) and (34–37), each with a center tap. The secondary windings are (unlike the schematic drawing, which uses the usual form applied in electrical engineering) all wound on the same core with the same coupling to the primary winding (30). The transformer used can be an air-core transformer or a transformer with magnetic core, for example a ferrite core. The hot ends of the secondary winding (33–36) supply the four hyberbolic electrodes in the normal way, opposing pairs of electrodes (40, 41) each being supplied with the same phase (the other two electrodes and their supply are not shown here). Two independently variable DC voltages (38) and (39) are fed in between the center taps of the two other secondary windings (32–35) and (34–37) and the aforementioned secondary winding (33–36). The ends (32) and (34) of these windings are each connected with the ends of the insulated thin metal layers (42, 43) applied to the electrodes (40, 41) in such a way that a DC current flows through the windings and the thin metal layer, generating a voltage drop across both ends of the thin metal layer, but at the same time carrying the same phase of the RF voltage. At location (44) the thin metal layers (42, 43) are connected to the hyperbolic electrodes beneath, making it possible to generate two independent voltage drops in the sections (45, 44) and (44, 46) of the quadrupole system. The RF voltage of these supply leads does not have to supply the entirety of the RF voltage to the thin metal layers (42, 43) in this case, since the RF voltage is partially supplied capacitively from the hyperbolic electrodes (40, 41) through the insulating layer. This simple circuit avoids the use of capacitors, resistors and chokes to connect the hot side of the transformer windings. One possibility is to use a litz wire made of three braided strands for the three windings.

Since the electrically conductive surface layers (42) and (43), which each form a thin metal layer insulated from the hyperbolic electrodes (40) and (41), are connected at location (44) with the hyperbolic electrodes (40) and (41) beneath, it is possible to form the voltage drop in the two partial sections (45, 44) and (44, 46) separately. By using four or more secondary windings in each case, it would also be possible to form three or more partial sections of the voltage drop if the resistance layers have suitably accessible taps. This would make it possible to produce different shapes of collection basins for the ions, which can be emptied by changing the DC voltages.

One of several applications of such quadrupole systems relates to a precision quadrupole mass filter providing high ion transmission even if operated at higher damping gas pressures.

In an RF quadrupole field, a pseudopotential repels the ions radially to the axis. The ions can execute oscillations in the pseudopotential well. The pseudopotential is not identical in strength for all ions: for light ions, the parabolic potential trough is narrow, and the oscillations are rapid; for heavy ions, the potential trough is very wide, the repelling pseudoforces are much weaker and the oscillations slower. For very light ions the oscillations are so rapid that they are thrown in a half wave of the RF voltage to the other side of the pseudopotential trough, where they experience an acceleration towards the electrode. They experience a synchronization with the RF and are accelerated out of the system. This is termed the lower mass limit for the storage of ions within the quadrupole system.

A mass filter is operated with a superimposed DC voltage in such a way that a positive DC potential is superimposed on one phase of the RF voltage, and a negative DC potential on the other phase. A DC voltage of one polarity is always connected to the same pair of electrodes. A saddle-shaped DC potential is thus superimposed on the repelling pseudopotential of the RF voltage in the interior of the quadrupole system, said DC potential exposing the same force to all ions of the same charge. Positive ions are drawn to the electrodes with negative DC potential. For heavy ions, however, the repelling pseudopotential is weak; these ions will impinge on the negative electrodes, discharge and leave the process. An upper mass limit of the quadrupole system is created.

If the DC potentials, from an absolute point of view, amount to around one sixth of the effective RF voltage, then the lower mass limit and the upper mass limit draw so close together that only ions with one particular mass-to-charge ratio can stably remain in the quadrupole system. These ions are maintained only very weakly in a stable state in the interior, since repelling pseudopotential and attractive DC potential almost balance each other. Even if injected ions have the correct mass-to-charge ratio, they are easily carried toward the electrodes if their angle of injection is even just slightly wrong. The term "low phase-space acceptance" is used here, the phase space being defined as a six-dimensional space comprising location and momentum coordinates.

It is known that the acceptance can be increased by using a ramp of the DC potentials at constant RF amplitude, especially when the oscillation of the ions is rapidly damped by a higher damping gas pressure. Until now, ramps of this type could only be generated in steps using individual upstream quadrupole systems ("prefilters"), since no method was known which could produce a continuous ramp. In practice, only a single upstream preliminary filter with RF voltage alone was used. The ramp of the DC potentials here does not have to begin at zero; on the contrary, it is sufficient to begin at around 80% to 95% of the DC potentials.

A continuous ramp can now be produced for the first time using a quadrupole system according to this invention. If, after around a quarter of the length of the quadrupole system, the surface resistance layer is connected to the lengthy electrodes below by means of a narrow scratch right through the insulating layer (see FIG. 1, for example), it is then possible to generate a ramp of this type in the first quarter by suitable choice of the potentials applied. It is also possible to apply the insulated resistance layer only in the first quarter of the quadrupole system. The ramp here is intended to attenuate both the negative potential of one of the pairs of lengthy electrodes and also the positive potential of the other pair of lengthy electrodes in the ion entrance, so that a deeper pseudopotential depression in the axis achieves a better acceptance for injected ions in this case. Thus, there are voltage drops required in opposite directions on adjacent resistance layers. The ramp makes it possible for ions in a quite broad mass range (more exactly: mass-to-charge ratio) to enter, but continuously narrows the stable mass range along the ramp, so that further undesirable ions are increasingly removed, while the oscillations of the desirable ions are increasingly damped by the damping gas, enabling them to favorably enter the strongly mass selective middle section of the mass filter.

Furthermore, in the quarter of the mass filter on the exit side, it is possible to use an analogous measure with a suitably positioned scratch (or a resistance layer which is only applied here) and a corresponding potential supply to achieve better collection of the ions in front of the exit in the axis of the system by means of a ramp in the opposite direction; this creates a better ejection behavior.

A mass filter of this type according to the invention with entrance ramp and exit ramp has a much higher transmission for the selected ions, and a much better behavior with respect to downstream ion systems, whatever their type. In particular, it can be used at much higher damping gas pressures; it is even the case that it operates better at higher damping gas pressures than in a "good" vacuum.

For the voltage supply of this new type of quadrupole filter it is advisable to use three secondary windings, and it is necessary to divide the secondary windings at their center in order to be able to feed in separate DC voltages with different polarities for the two phases of the RF voltage. With three secondary windings it is possible to achieve a situation where the entrance ramp and the exit ramp can be charged slightly differently with DC potentials in order to generate a residual potential gradient in the axis of the quadrupole system by means of an incomplete compensation of the ramp voltages, for example; the residual potential gradient drives the ions from the entrance to the mass selecting center part, and from there to the exit.

In a further embodiment, the precision mass filter can maintain slight potential differences in the first and third quarter of the quadrupole system in such a way that it transports ions to the exit. This quadrupole system can be operated like this at even higher damping gas pressures and still be charged with ions of very low kinetic energies without the ions damped in the quadrupole system sticking in the quadrupole system and not reaching the exit.

A further application of the quadrupole system according to the invention relates to a collision cell for the fragmentation of ions. It is advantageous if the collision cell here is designed as a hyperbolic quadrupole system, since only then is it possible to minimize the ion losses resulting from lateral escape or nonlinear resonances.

A glass quadrupole system according to FIG. 2 is eminently suitable for filling with collision gas. Clean nitrogen can be used for this purpose; it is not necessary to supply the system with expensive helium since, even with collision gases of higher molecular weights, the collision cascades with random lateral deflection do not immediately lead to ion losses. Nitrogen as the collision gas has a higher fragmentation yield. It is even possible to use argon as the collision gas, with an even higher fragmentation yield. It is advisable to make the injection and ejection apertures as fine as possible in order to maintain high pressure in the collision cell without filling the vacuum in the surrounding mass spectrometers with more collision gas than can be tolerated.

Gas mixtures, for example helium and argon, can create an equilibrium between thermalization and fragmentation. In this case, the helium is mainly responsible for thermalization, the argon for fragmentation. The mixture enables a desired ratio of fragmentation to cooling to be produced.

When used as a collision cell, the hyberbolic quadrupole system is sealed at both ends with apertured diaphragm systems. The apertured diaphragm system at the entrance end accelerates the ions during injection and provides them with sufficient energy for the subsequent fragmentation; the apertured diaphragm system at the exit end repels all ions except for a needle-sharp potential minimum in the axis to allow thermalized ions to flow out. The ions injected with energies of between 30 and 200 electron-volts will first traverse the collision cell with a few hundred collisions and be reflected at the diaphragm system at the exit end. On returning to the diaphragm system at the entrance end they are reflected again; they thus oscillate in the hyperbolic quadrupole system until they are thermalized. This causes a high proportion of the ions to be fragmented; this proportion depends on the collision density and the power of the collision. The collision density is given by the number of collision gas molecules, the power of the collision by their mass. A weak potential gradient created along the quadrupole system according to the invention allows the thermalized ions to flow toward the exit in front of the diaphragm system, where they collect in an "ion pool". It is advisable to keep the potential of the outflow aperture in the axis of the diaphragm system so that a certain quantity of thermalized ions first have to fill the ion pool with a certain "overflow pressure" before the ions can emerge via the slight potential threshold in the exit hole. The overflow pressure is formed by the Coulombic repulsion of the ions in the ion pool. This overflow out of an ion pool provides exiting ions with extraordinarily homogeneous energies ("monoenergetic ions").

An ion beam can be formed from the outflowing monoenergetic ions, which is eminently suitable for a time-of-flight mass spectrometer with orthogonal injection, for example, and also for other mass spectrometers which serve to analyze fragment ions. The quantity of ions in the ion pool, which brings about the outflow, depends on the profile of the DC voltage along the quadrupole system. As described above, this profile can be generated by three or more windings of the RF transformer and corresponding taps on the resistance layer. Controlling the voltage drop in front of the apertured diaphragm system at the exit end makes it possible to empty the pool slowly and completely to measure a daughter ion spectrum.

Those skilled in the art will recognize that many more possible applications for quadrupole systems exist which can be improved by creating DC potential profiles with knowledge of this invention.

What is claimed is:

1. RF quadrupole system made of lengthy electrodes, wherein the electrodes consist of a material with good electrical conductivity, carrying at their surface a thin insulating layer covered by a thin conductive layer, and wherein for each of the electrodes, the electrodes and the ends of their thin conductive layers are connected to different DC potentials superimposed by the same phase of the RF voltage, the phases of the superimposed RF voltage changing in turn from electrode to electrode.

2. RF quadrupole system according to claim 1, wherein the thin conductive layers are each electrically connected to the corresponding electrode beneath at least at one distinct location.

3. RF quadrupole system according to claim 1, wherein the thin conductive layers on the electrodes have a maximum thickness of ten micrometers.

4. RF quadrupole system according to one of the claims 1, wherein the longitudinal resistances of the thin conductive layers are between one and a hundred kiloohms.

5. RF quadrupole system according to one of the claims 1, wherein parts of the surface of the electrodes have a hyperbolic shape, said surfaces being positioned diagonally opposite each other in the quadrupole system.

6. RF quadrupole system according to claim 5, wherein only the hyperbolically shaped parts of the surface are coated with insulated thin conductive layers.

7. RF quadrupole system according to claim 1, wherein the DC potentials applied to the electrodes and to the ends of the thin conductive layers, are supplied by means of center taps on separate secondary windings of an RF transformer.

8. RF quadrupole system according to claim 1, wherein the DC potentials are adjustable.

9. RF quadrupole system according to claim 1 for selecting ions according to their mass-to-charge ratio, wherein a) a first set of DC voltages of opposite polarity is superimposed on the two phases of the RF voltages in order to select ion species in a preset range of mass-to-charge ratios, b) the thin conductive layers are connected to the electrodes beneath at one location, and c) further DC potentials are applied along the thin conductive layers, said potentials attenuate the first set of DC voltages in the injection region for ions, the attenuation disappearing in the shape of a ramp into the interior of the quadrupole system.

10. RF quadrupole system according to claim 9, wherein in the ejection region, a ramp for collecting the selected ions in the axis of the quadrupole system is set up by means of a third set of DC potentials which gradually attenuate the first set of DC voltages.

11. RF quadrupole system according to claim 9, wherein a damping gas maintains a damping pressure to damp the transverse oscillations of ions.

* * * * *